US008534952B2

(12) United States Patent
Vladislavic

(10) Patent No.: US 8,534,952 B2
(45) Date of Patent: Sep. 17, 2013

(54) VISUAL HIGHLIGHT ACCESSORY FOR HIGHWAY GUARDRAILS

(76) Inventor: Neven Ilic Vladislavic, Santiago (CL)

( * ) Notice: Subject to any disclaimer, the term of this patent is extended or adjusted under 35 U.S.C. 154(b) by 0 days.

(21) Appl. No.: 13/200,695

(22) Filed: Sep. 28, 2011

(65) Prior Publication Data

US 2012/0080654 A1 Apr. 5, 2012

(51) Int. Cl.
*E01F 15/04* (2006.01)

(52) U.S. Cl.
USPC ..... 404/9; 404/6; 256/13.1

(58) Field of Classification Search
USPC ..... 404/6, 9, 10; 256/1, 13.1; 116/63 R; D10/111; 403/354, 375; 24/589.1, 593.1
See application file for complete search history.

(56) References Cited

U.S. PATENT DOCUMENTS 3,214,142 A * 10/1965 Brown ..... 256/13.1
4,000,882 A * 1/1977 Penton ..... 256/13.1
4,191,449 A * 3/1980 Hirata ..... 359/552
4,222,552 A * 9/1980 Matteo, Sr. ..... 256/13.1
4,460,161 A * 7/1984 Grenga ..... 256/13.1
4,686,785 A * 8/1987 Obbermito ..... 40/607.13
4,723,758 A * 2/1988 Gehrig ..... 256/13.1
5,152,507 A 10/1992 Lee
5,676,488 A * 10/1997 Hedblom ..... 404/9
5,941,655 A * 8/1999 Jacobs et al. ..... 404/14
5,950,992 A * 9/1999 Weid ..... 256/13.1
6,173,943 B1 1/2001 Welch et al.
D438,135 S * 2/2001 DiDomizio et al. ..... D10/111
6,233,898 B1 * 5/2001 Burlando ..... 404/9
6,451,408 B1 * 9/2002 Haunschild et al. ..... 428/143
6,533,249 B2 3/2003 Ochoa
7,014,389 B1 * 3/2006 Siblik ..... 404/10
7,263,790 B2 * 9/2007 Richards ..... 40/306
7,523,576 B1 * 4/2009 Petty ..... 40/664

* cited by examiner

*Primary Examiner* — Matthew D Troutman
(74) *Attorney, Agent, or Firm* — D. Peter Hochberg; Sean F. Mellino

(57) ABSTRACT

A visual highlight accessory for attachment to highway guardrails has a paint coating and a clear varnish overcoating with mica particles for making the visual highlight accessory and the guardrail on which the visual highlight accessory is mounted readily visible to persons in vehicles travelling along a highway along which the visual highlight accessory borders. The visual highlight accessory has orifices corresponding to orifices in the guardrails to facilitate mounting of the visual highlight accessory on a guardrail.

10 Claims, 10 Drawing Sheets

VISUAL HIGHLIGHT ACCESSORY FOR HIGHWAY GUARDRAILS

CROSS-REFERENCE TO RELATED APPLICATIONS

This application claims priority of Chilean utility model application No. 01052 filed Sep. 30, 2010.

BACKGROUND OF THE INVENTION

1. Field of the Invention

This invention relates to guardrails, namely highway guardrails, and more particularly apparatus for making guardrails readily noticeable to drivers of motor vehicles on the highways and roadways having guardrails bordering the sides and medians between lanes of traffic on highways and roadways.

2. Description of the Prior Art

Guardrails bordering highways and roadways are well known in the United States and throughout the world. Highways are usually bordered with continuous, horizontal metal guardrails, having guardrail beams attached to regularly spaced vertical posts spaced at equal distances along the highways and roadways, and anchored to the ground. (Highways and roadways will hereinafter be defined as "highways.") The continuous guardrail beams are generally attached to the vertically-anchored posts for holding one or more horizontal guardrail beams between the vertical posts.

The horizontal guardrail beam is generally composed of a continuous horizontal rail or beam which may have a double-wave shape, generally referred to as a W-beam made from standard heavy gauge metal. Each guardrail beam usually has at least two folds to provide a typical W-beam cross section. A series of post bolt holes and splice bolt slots are included in the guardrail beams so that they can be used interchangeably with existing guardrail systems. W-beam guardrails very often comply with the American Association of State Highway Transportation Official (AASHTO) Designation M180-89. Designation 180-89 Class Type A specifies that the overall length of the W-beam guardrail is respectively 4.318 meters with an effective length 4.0 meters or 4.128 meters with an effective length of 3.81 meters; the uncoated thickness for both lengths is 2.67 mm; and the weight is respectively 46 kg or 44 kg. Highway guardrails have end treatments. Guardrail beams are conventionally made by roll-forming methods using steel alloy materials. The W-beam guardrail is galvanized and coated with a zinc covering to avoid corrosion and increase the life of the guardrail. AASHTO Designation M180-89 for galvanizing has a minimum single-spot test of 1,100 g/m$^2$ (3.603 oz/ft$^2$) and a minimum triple-spot test of 1,220 g/m$^2$ (4.003 oz/ft$^2$). A requirement for galvanizing is to be in accordance with ASTM A123.

A serious and very common problem with guardrails is that they are not highly visible to drivers of motor vehicles on the highways which are bordered by the guardrails due in part to the color of the guardrails, to deterioration of the guardrails and to the large number of other motor vehicles that are close to any particular motor vehicle traveling on the highway. The visibility of guardrails is very important for both daytime and night-time driving, since the guardrails should be readily apparent during the day under ambient light, and at night from the reflection of headlights and sometimes street lamps along the highway. Another problem with the visibility of guardrails is that motor vehicles travel very fast, particularly along long, slightly curved highways, requiring each driver to concentrate on the highway itself rather than on the guardrails. Furthermore, guardrails tend to be covered with dirt and dust due in part to the fast moving vehicles traveling along the highways and due in part to the weather, and there is little or no cleaning of the guardrails where they are used. Support posts are provided for supporting and maintaining the highway guardrails horizontally along the highway. The posts are anchored to the ground, and may be fabricated from metal, wood or a combination of metal and wood. One often-used requirement for metal posts is that they meet the requirements of ASTM A36/A36M.

There are various techniques which are presently being used to enhance the visibility of guardrails. These generally involve using readily visible paint or fluorescent adhesive tapes that are put on the guardrails after the guardrail system has been installed. However, it has been found in practice that these techniques do not have a sufficiently long duration of being effective, they are not as visible as would be desired, and many accidents have occurred with lateral or frontal impacts of motor vehicles. Some presently available products include an I-Beam Reflector/Protector from HSS Traffic Control Products, Fort Wayne, Ind., for attachment to guardrails, different types of reflecting devices for being attached to guardrail systems and types of reflective tapes. One reflective sheet is 3M™ Diamond Grade™ Fluorescent Sheeting, 3M Corporation, St. Paul, Minn. However, these have not proven effective. The conventional techniques of rendering guardrails more apparent to drivers are economically inefficient, particularly with installed guardrail systems, because they require an intensive maintenance program with high labor costs and the expense of replacement materials in order to keep the guardrails visible. It has recently been stated: "Chronic lack of research is highlighted with particular reference to visibility and its inadequate treatment in design standards." Douglas Stewart, Civil Engineering 160, pp. 131-136.

BRIEF SUMMARY OF THE INVENTION

It is an object of the present invention to provide a product for improving the visibility of guardrails so that they are readily observable by drivers of motor vehicles along highways which are bordered by the guardrails.

Another object of the present invention is to provide an improved product for rendering guardrails readily apparent to drivers of motor vehicles on highways or roadways bordered by the guardrails which can be installed at relatively low expense.

It is still another object of the present invention to provide a product for improving the visibility of highway guardrails including a product which is easy to transport from a storage facility to the respective highways where the guardrails are to be installed.

Another important object of the present invention is to provide a product for enhancing the visibility of highway guardrails to drivers of motor vehicles traveling along highways bordered by the guardrails, which product is highly reflective and works well both at nighttime and during the day.

It is also an object of the present invention to provide a covering for a visual highlight accessory for highway guardrails which is more visible to drivers of motor vehicles along highways bordered by the guardrails than are presently available using paints and other coverings.

A still further object of the present invention is to provide a visual highlight accessory to be applied to guardrail systems which is made of a product which would not deteriorate in the environment and can be applied using inexpensive application techniques.

It is still another object of the present invention to provide a guardrail visibility system which is readily observable by drivers of motor vehicles along highways bordered by the guardrails at all angles of perception, rendering the guardrail beams readily visible as drivers pass continuously placed guardrails.

A yet further object of the present invention is to provide product for enhancing the visibility of guardrail beams which does not detrimentally change the shape of the respective guardrail beams.

Another object is to provide a visual highlight accessory for guardrail beams which covers the guardrails and which has the same length as the guardrails and has holes the same as the holes in the guardrails so that the same bolts or other fastener can be used for attaching the respective accessories to the guardrails as are used for attaching the guardrails to each other in an overlapping means or by means of a connector as is well known in the art and widely practiced in the United States and around the world.

It is also an object of the present invention to provide a covering for guardrail beams in the form of an improved paint which not only improves the visual brightness of the guardrail beams, but further keeps the base color of the guardrail beam unchanged while increasing the reflectability of the paint.

A basic object of the invention is to prevent vehicular accidents between vehicles and guardrails and to avoid injury and save lives of persons in the vehicles.

A general object of the present invention is to provide an improved system for enhancing the visibility of guardrails to drivers of motor vehicles traveling along the highways bordered by the guardrails, which system is effective in operation, and efficient to install and maintain.

These and other objects of the present invention should be apparent to those skilled in the art from the description to follow and from the appended claims.

The invention in its preferred form includes, in part, a covering including a brightly colored paint on top of which is coated with clear, non-color or a transparent varnish having fine mica particles dispersed therein for providing a strong reflective effect on the surface on which it is coated. The paint and varnish are preferably made from a polyester resin, and the fine mica particles result from an organic pigmentation.

Another aspect of the present invention is a visual highlight accessory which is secured to a highway guardrail, and the accessory can be made from galvanized steel sheet, aluminum or polyvinyl chloride (PVC), the latter being shaped as desired using an extrusion machine. The visual highlight accessory is preferably first coated with the paint, preferably bright yellow paint. A coating compound made with a mixture of clear varnish and mica is applied to the accessory with a coater machine. The visual highlight accessory is then placed in an oven to dry with ultraviolet lamps. The visual highlight accessory is preferably very smooth to reduce or eliminate any cleaning thereof.

Galvanized steel sheet and aluminum are the preferred materials since they allow for easy shaping using a roll-forming process, are easy to handle, and provide a long-lasting attachment when the metal accessory is mounted on an existing respective highway guardrail beam.

If the visual highlight accessory is made from PVC as described above, the PVC has a corona treatment for opening the pores on the PVC in order to achieve the stronger adherence of the varnish mixed with mica.

A highway guardrail system, as mentioned above, includes horizontal guardrail beams attached to vertical posts anchored to the ground. The horizontal guardrail beams as installed are fixed to the vertical posts with bolts and nuts which are generally the same for the respective highway guardrail systems.

DETAILED DESCRIPTION OF THE PREFERRED EMBODIMENT

Figure 1:
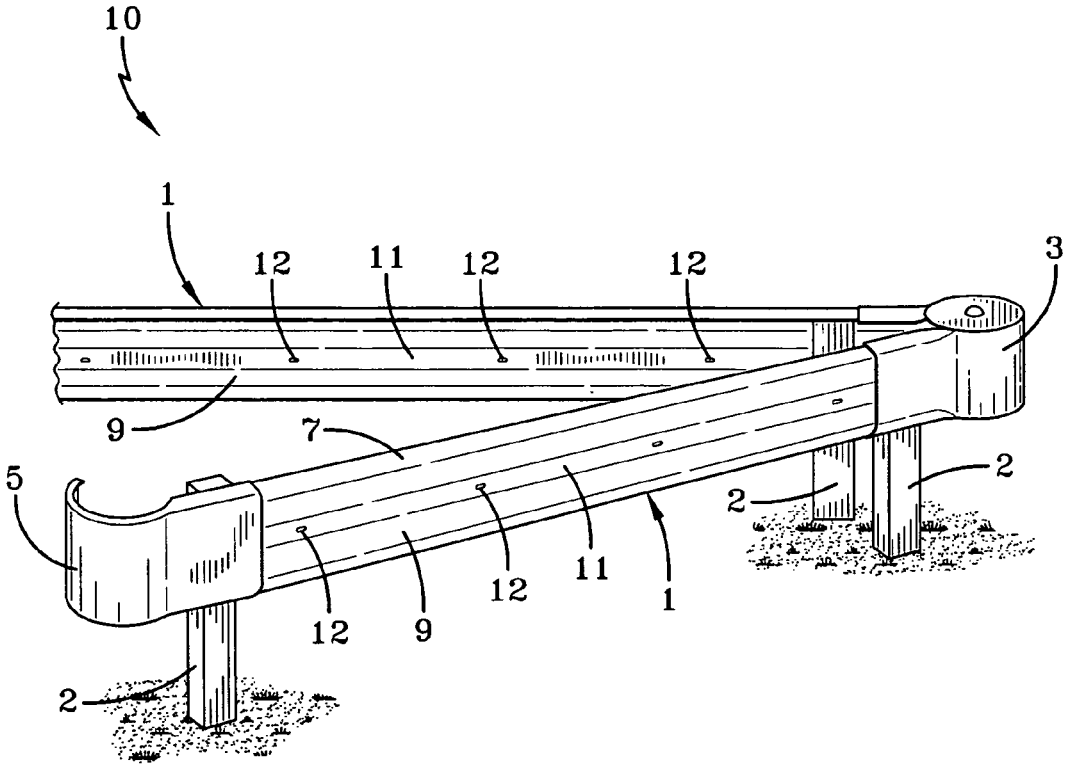
FIG. 1 is an isometric view of a portion of the highway guardrail system employing W-beam guardrails fixed to vertical posts.

Referring to FIG. 1, a guardrail assembly 10 is shown. Guardrail assembly 10 includes a pair of W-beam guardrails 1 which are connected together by a corner brace 3 and mounted on a pair of spaced vertical posts 2 which are anchored to the ground. One of W-beam guardrails 1 extends between the corner brace 3 and another brace 5 which are affixed to another anchored post 2 and could be attached to an end anchor treatment. W-beam guardrail 1 is shown as having a double-wave shape with an upper crown 7 and a lower crown 9, which are connected together by an integral transition component 11.

Another guardrail assembly 100 is shown for a slightly different guardrail assembly with which the present invention can be used, which varies slightly from guardrail assembly 10 shown in FIG. 1. Guardrail assembly 100 includes a set of W-beam guardrails 101 having a set of holes 103 through which bolts extend for attachment to other guardrails 101 in a succession of guardrails 101. The bolts extending through holes 103 would normally be held in place by a set of nuts. Oval splice bolt slots 105 each receive a bolt 107 which extends through a rectangular washer 109 and then through slot 105 for attachment to a vertical post 2, which in this case includes a separator 111. Separator 111 is a modular unit which is composed of a pair of parallel flanges 113 lying in general planes which are perpendicular to vertical post 2 and to W-beam guardrail 101 when it is attached thereto. Parallel flanges 113 are attached to a separator plate 115 which is perpendicular to flanges 113 and to W-beam guardrail 37. A washer 117 is disposed between flanges 113 and parallel to washer 109 for receiving bolt 107 passing through washer 109 and one of holes 103 to attach W-beam guardrail 101 to post 2. Separator 111 has holes for receiving one of bolts 119 which extend through one of three vertically oriented oval splice bolt slots 121. Guardrail system 100 is oriented as shown along the border of a highway whose direction of vehicle flow is shown by the arrow 123. The foregoing is intended to provide a better understanding of a guardrail system with which a visual highlight accessory 16 would be used in an actual operating environment.

Figure 2:
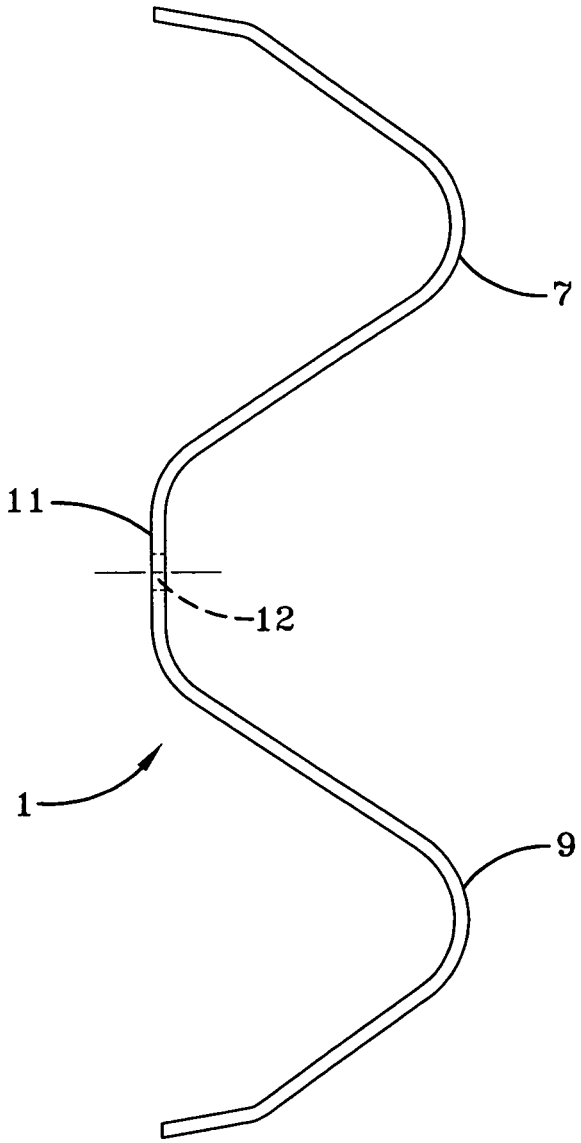
FIG. 2 is a cross-sectional view of a W-beam guardrails shown in FIG. 1.

Referring next to FIG. 2, a cross-sectional view of W-beam guardrail 1 is shown. Upper crown 7 and lower crown 9, and integral transition component 11 are clearly shown. As mentioned previously, W-beam guardrail 1 could be expected to meet AASHTO Designation M180-89 standards.

Figure 3:
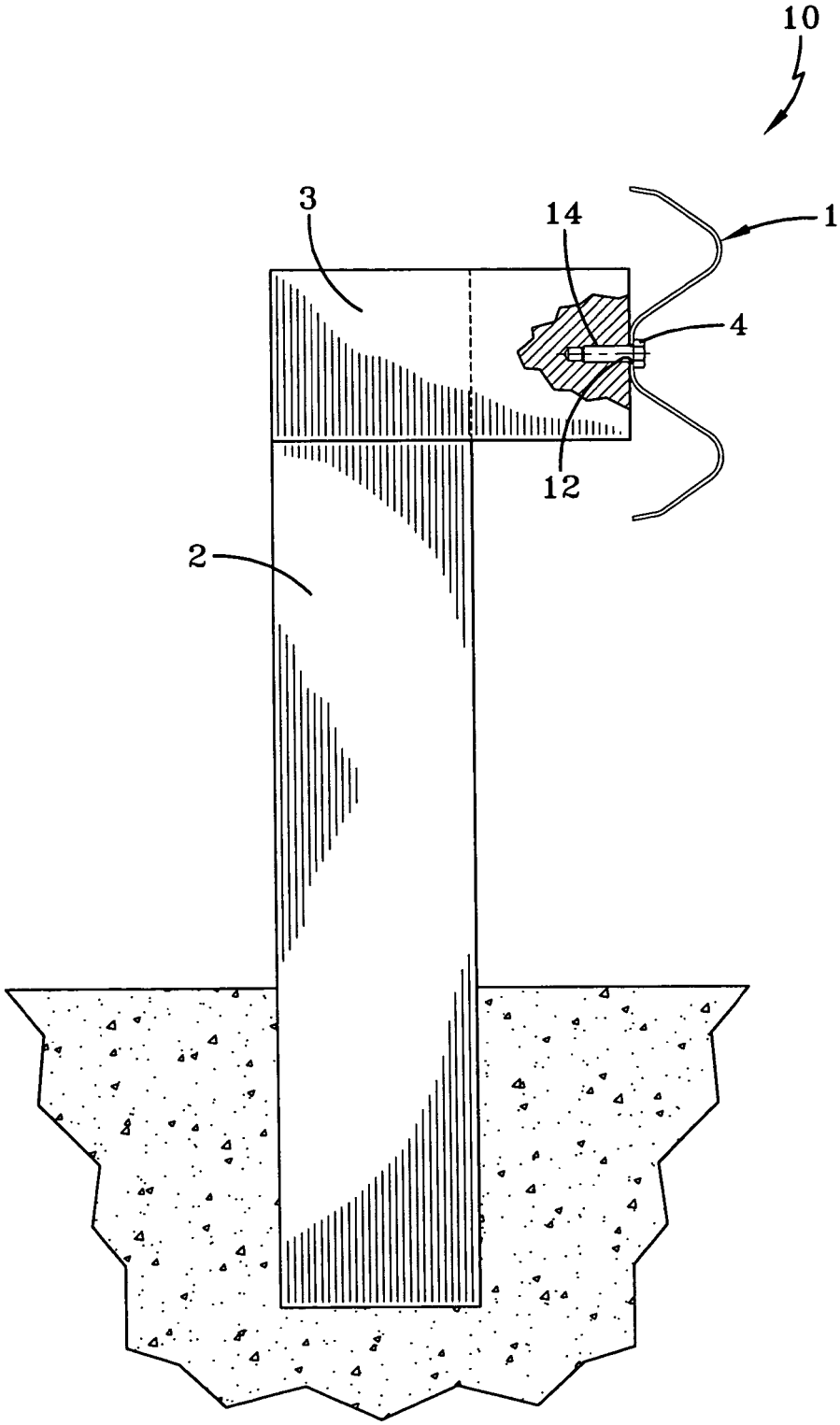
FIG. 3 is a cross-sectional view of a horizontal W-beam guardrail mounted on a vertical post.

Turning next to FIG. 3, W-beam guardrail system 10 is shown in a side view. W-beam guardrail 1 is shown attached to post 2 by means of brace 3. This is accomplished by means of one of bolts 4 which extend through an oval hole 12 in transition component 11 of W-beam guardrail 1, and a brace hole 14 in brace 3.

Figure 4:
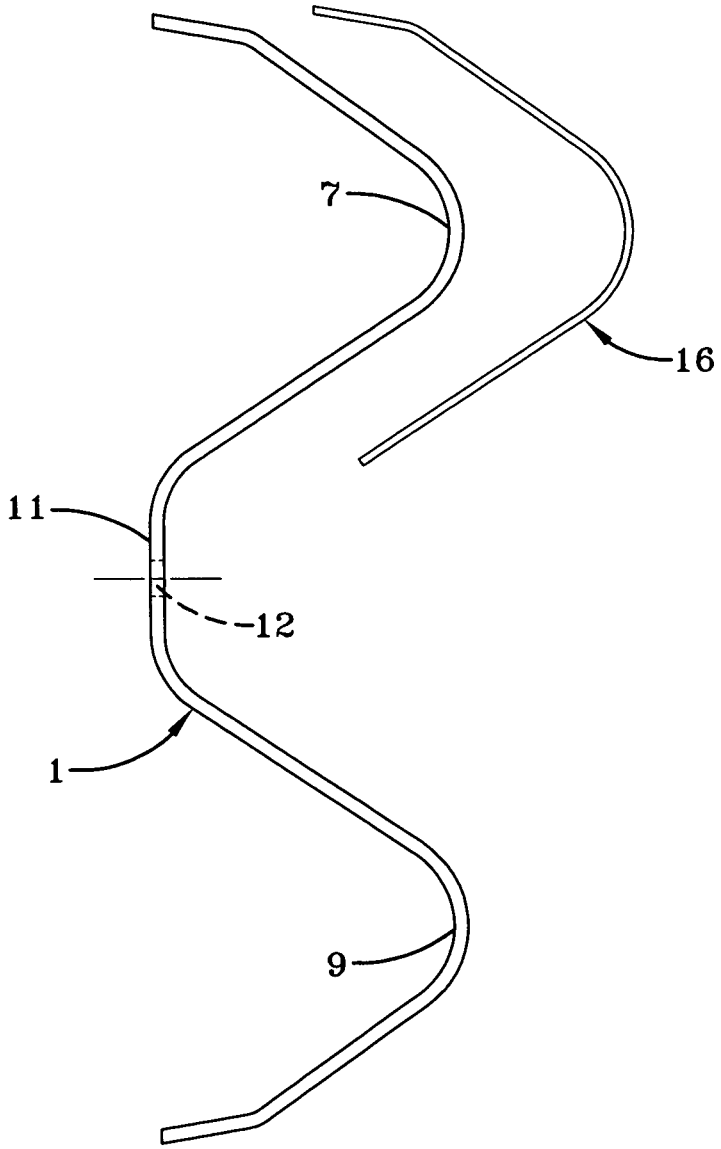
FIG. 4 is a cross-sectional view of a W-beam guardrail having a visual highlight accessory according to the preferred embodiment of the invention mounted thereon.
Figure 5:
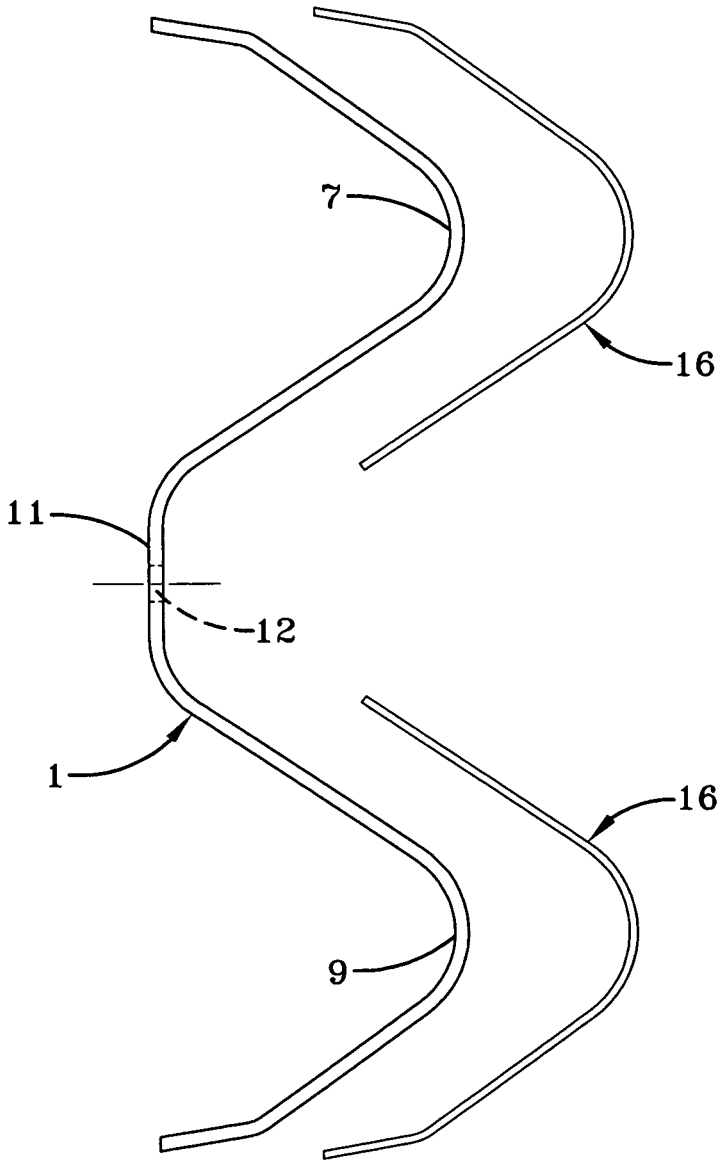
FIG. 5 is a cross-sectional view of a W-beam guardrail with a pair of visual highlight accessories attached thereto according to the preferred embodiment of the invention.

Referring next to FIG. 4, W-beam guardrail 1 is shown having its upper crown 7, lower crown 9 and transition component 11. Shown in an exploded view is a visual highlight accessory 16 forming part of the invention, which is positioned to be attached to upper crown 7. Accessory 16 is configured the same as upper crown 7 so that it can be attached to upper crown 7 with the two pieces being substantially in contact. Likewise, referring to FIG. 5, a pair of accessories 16 are shown as being ready to be attached to upper crown 7 and lower crown 9 of W-beam guardrail 1.

Figure 6:
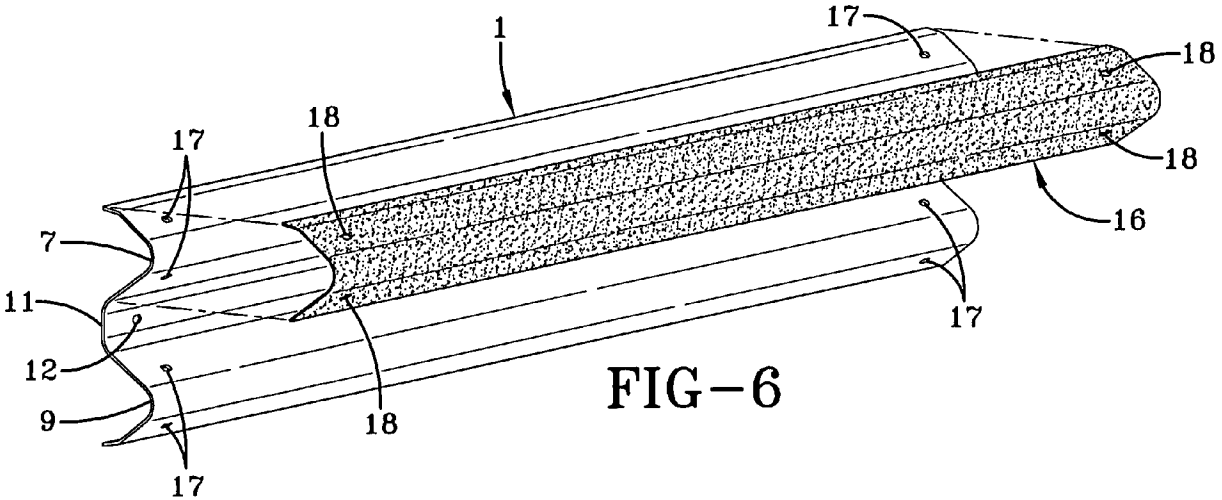
FIG. 6 is an isometric view of a W-beam guardrail having a visual highlight accessory according to a preferred embodiment of the invention about to be attached thereto.
Figure 7:
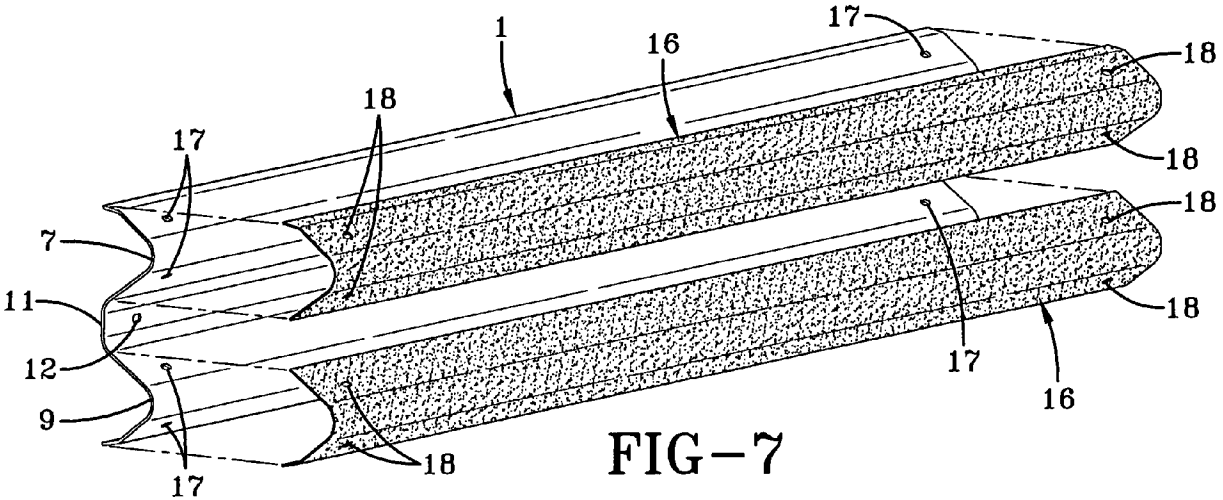
FIG. 7 is similar to that of FIG. 6 showing a pair of visual highlight accessories about to be attached to a W-beam guardrail.
Figure 10:
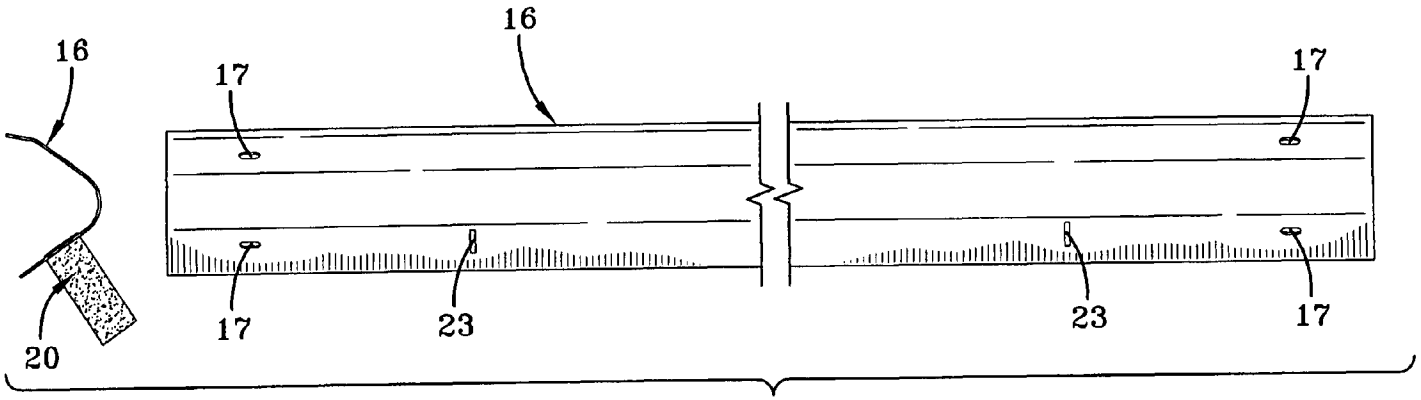
FIG. 10 is a front view of a visual highlight accessory as shown in FIG. 9 after having been bent or folded.

Referring next to FIGS. 6 and 7, W-beam guardrail 1 is shown with upper crown 7, lower crown 9 and transition component 11. Visual highlight accessory 16 is shown in FIG. 6 as being ready to be installed on upper crown 7. W-beam guardrail 1 includes a set of oval splice bolt slots 17 which are disposed one over the other, with two slots 17 in upper crown 7 and two slots 17 in lower crown 9. It is shown in FIGS. 6 and 7 that oval splice bolt slots 17 are at both ends of W-beam guardrail 1. Likewise, accessory 16 has oval slots 18 corresponding to slots 17. Slots 17 and 18 are each dimensioned so that they can receive the same bolts, so there is no need for a separate set of bolts for each of slots 17 and 18. (If slots 17 and 18 were circles, they would have the same diameter.) When visual highlight assembly 16 is fitted against upper crown 7 so that slots 17 are in line with oval slots 18, a bolt can be inserted into the respective slots 17 and 18 and a nut applied to the respective bolt so that visual highlight assembly 16 is held fast against upper crown 7 of W-beam guardrail 1. The same situation is true for visual highlight assembly 16 which is fitted over lower crown 9 of W-beam guardrail 1. As shown in FIG. 10, slot 17 is elongated in the vertical direction, and this permits a slight amount of vertical movement between accessory 16 on W-beam guardrail 1 without affecting its performance.

As shown in FIGS. 6 and 7, visual highlight accessory 16 is of the same length as the length of W-beam guardrail 1, has holes (which could be slots) of the same diameter as the holes of guardrail 1 (or at least the same shortest cross dimension if slots 17 and 18 are elongated) and the same distance between the holes to enable them to receive the same bolts or other fasteners. Since the same nuts and bolts would preferably be used to install the respective accessories 16 to W-beam guardrails 1, this would simplify obtaining the respective parts and installing them.

Figure 8A:
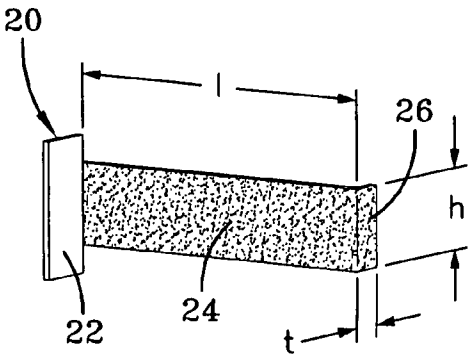
FIG. 8 is an isometric view of a W-beam guardrail with a visual highlight accessory according to a preferred embodiment of the invention in position for being assembled, and a set of fins having reflective tape attached thereto with a detailed enlargement of a part of the view.
Figure 8:
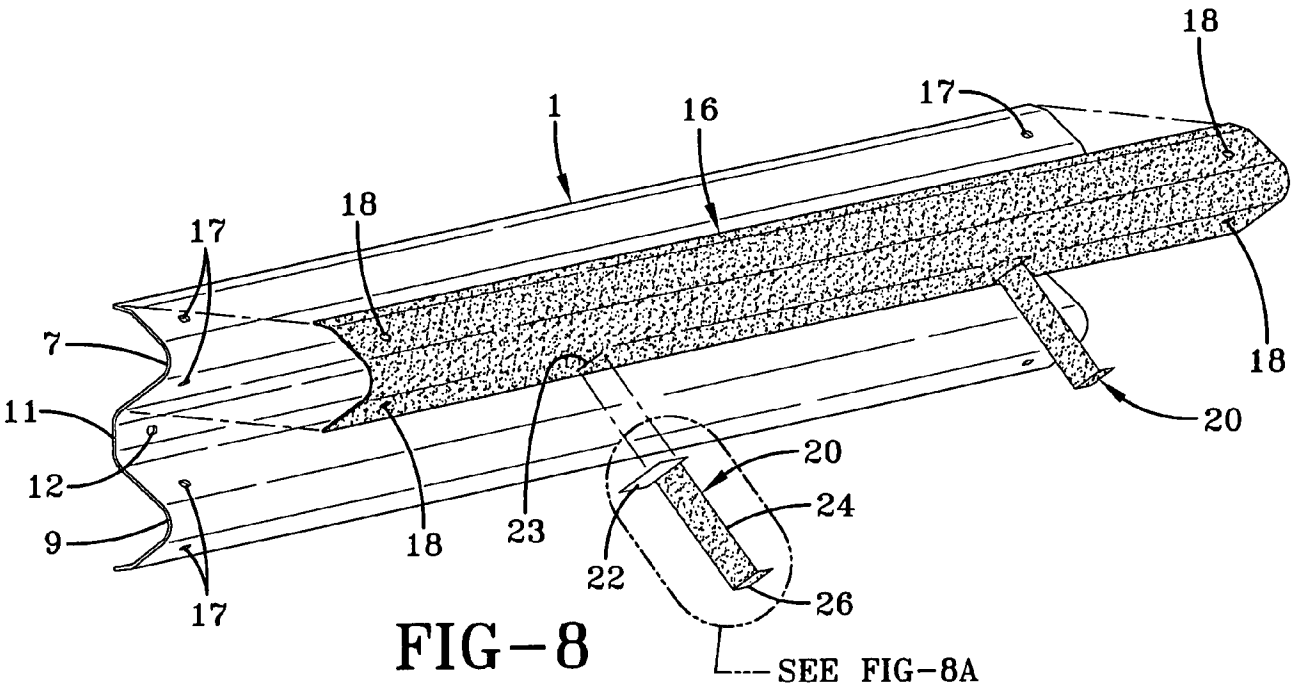
Figure 9:
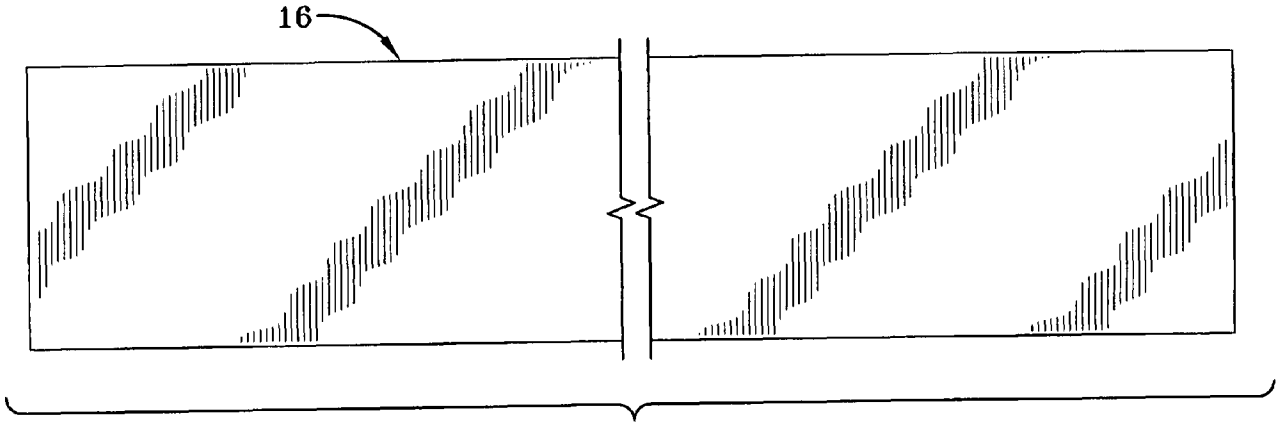
FIG. 9 is a front view of a visual highlight accessory according to the preferred embodiment of the invention in its painted condition, prior to being folded to the W-shape.

Turning to FIG. 8, W-beam guardrail 1 is depicted with visual highlight assembly 16 in position to be attached thereto. In addition to the bright color and reflectivity which is part of visual highlight accessory 16 as discussed below, a set of fins 20 are attached to W-beam guardrail 1 which extend from respective blades 22 discussed below. Referring to the enlarged detail shown in FIG. 8, each fin 20 preferably has a length 1 of preferably 70 mm, a height of 60 mm and a thickness of preferably 1 mm. Attached to the face of each fin 20 is a reflecting tape 24. With reference to the detailed enlargement incorporated in FIG. 8, it can be seen that there is a fold 26 which need be only 10°. Fold 26 adds tension to fin 20 to provide resistance to wind. Reflecting tape 24 with fold 26 reflects vehicle headlights and street lights to assist in alerting vehicle drivers of the presence of guardrail system 1. Blades 22, extending from the base of respective fins 20, have a length of preferably 60 mm rather than 50 mm (the latter being the height of slit 23), and are placed on the inside of accessory 16 facing toward the outside of accessory 16. Faces 21 extend outwardly as shown. The wider blade 22 makes it difficult to remove fin 20 from accessory 16 and helps to avoid theft. Thefts should be difficult to occur because fins 20 are not held in place by bolts (which also would add expense), but by the increased height of blades 22. Slits have been made which have a length of 51 mm and a width of 1.5 mm, and fins 20 have a length of 50 mm for entering slits 23, and a gauge of 1.0 mm to fit through the 1.5 mm width. Each fin 20 is bent 90° to form blade 22 in a press in a manufacturing shop. Blade 20 is located on the inside of slit 23 to make it difficult to remove, thus preventing or at least making theft of fins 20 more difficult. Each fin 20 is installed from behind accessory 16 (on the side to face guardrail 16) before visual highlight accessory 16 is installed on guardrail 1. Face 21, blade 22 and fold 26 are each flat. Blade 22 may be provided with a curve corresponding to the curve of the back of visual highlight accessory 16 to provide intimate contact between blade 22 and accessory 16 for a more positive seating of fin 20 against accessory 16. Reflector tape 24 is placed on fin 20 in a shop and not on site. Reflecting tape 24 could, for example, be 3M™ Diamond Grade™ Fluorescent Sheeting, discussed earlier FIG. 9 shows visual highlight accessory 16 prior to being bent or folded. Oval splice bolt slots 17 are visible. Their dimensions have been found effective if their longest length is 52 mm and their width is 1.5 mm. These slots can advantageously be made with an eccentric press. It has been found effective if the length of each visual highlight accessory 16 is 4318 mm, and their width is 200 mm, as is each crown 7 and 9 of W-beam guardrail 1.

Guardrails 1 could overlap each other, as could accessories 16. Each accessory 16 is preferably painted with a bright color, especially with a base yellow paint that gives high reflectivity to vehicle headlights and street lights. A particularly good paint is called Yellow Traffic Ral 1023 due to its brightness and its ability to remain effective and last in the exterior for a long time, oftentimes 15 years or more. Yellow Traffic Ral 1023 is available for example from Columbia Coatings, Columbia, Tenn. This paint is much better than conventional paints which may only last for two years. Yellow Traffic Ral 1023 is an effective reflective highlighter at night, in fog and in snow, especially when there is a layer of clear varnish and mica.

When accessory 16 is made of metal, it is advantageous if its surface is smooth and free of dust. This makes the yellow paint with reflective material more effective. If the accessory 16 is made from PVC, the color comes out directly from the extrusion manufacturing process.

Varnish is poured into a drum with which mica particles are mixed. The varnish is preferably clear. The varnish and mica combination is put in a coater machine, and the previously painted accessory 16 is passed through the coater machine, and through an oven with UV lamps for drying the varnish. A particularly effective varnish is Duranar® fluoropolymer coil coating. The latter coating is a combination of a PPG proprietary resin and pigment technologies with 70% of the resin system being fluoropolymer base resins. This coating is highly resistant to chalking, fading, chipping and peeling when properly applied. Duranar® coatings are available from PPG Industries, Inc., 151 Colfax Street, Springdale, Pa. 15144. Another effective coating is a Truform ZT polyester coil coating which is designed for one or two-coat application on aluminum or steel. Truform ZT coil coatings offer good surface hardness as well as excellent flexibility and resistance to metal marking, marring and staining. They also can be obtained from PPG Industries, Inc. at the address noted above.

Figure 11:
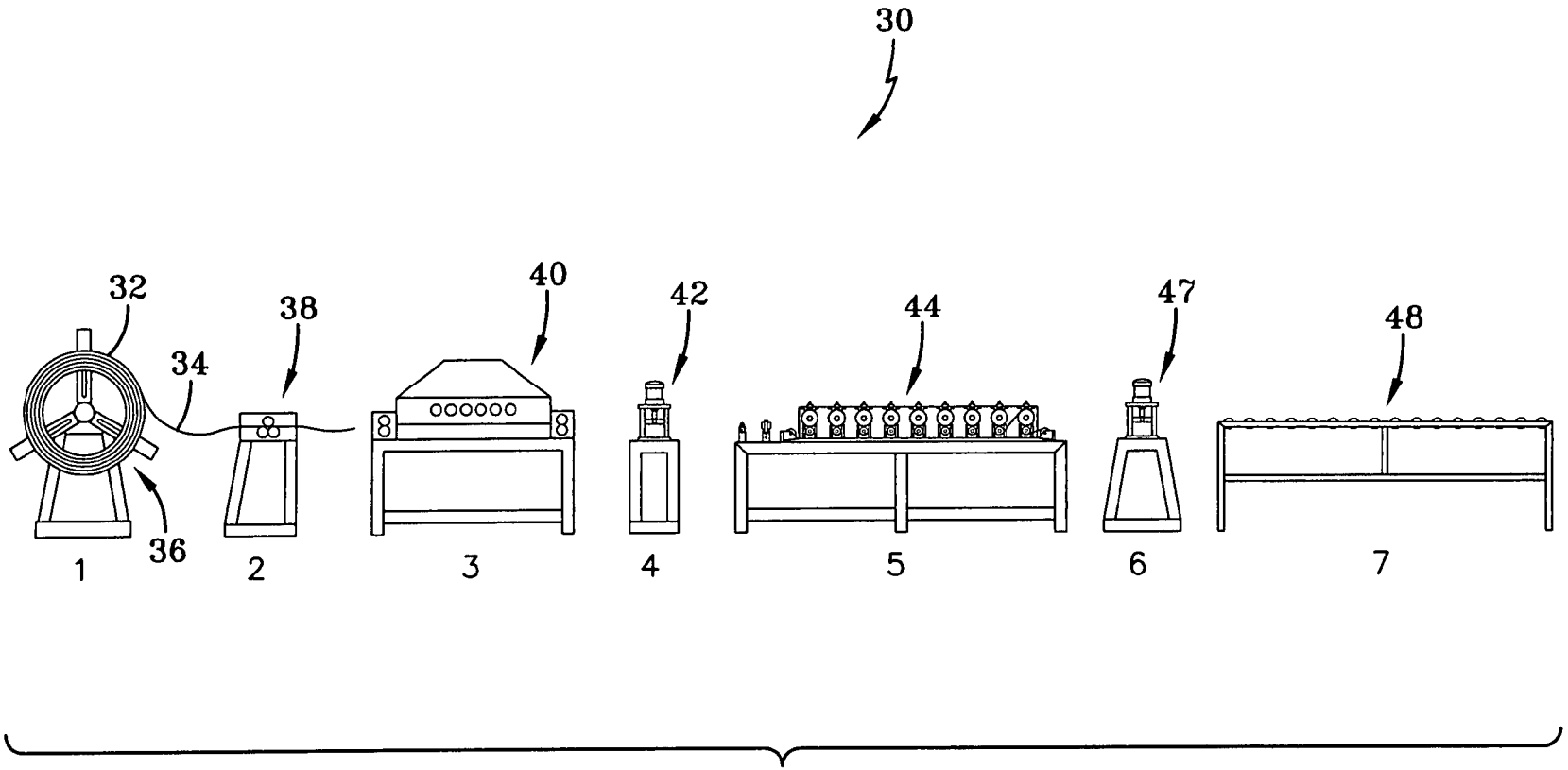
FIG. 11 is a schematic view of a machine line for manufacturing a visual highlight accessory according to a preferred embodiment of the invention.
Figure 12:
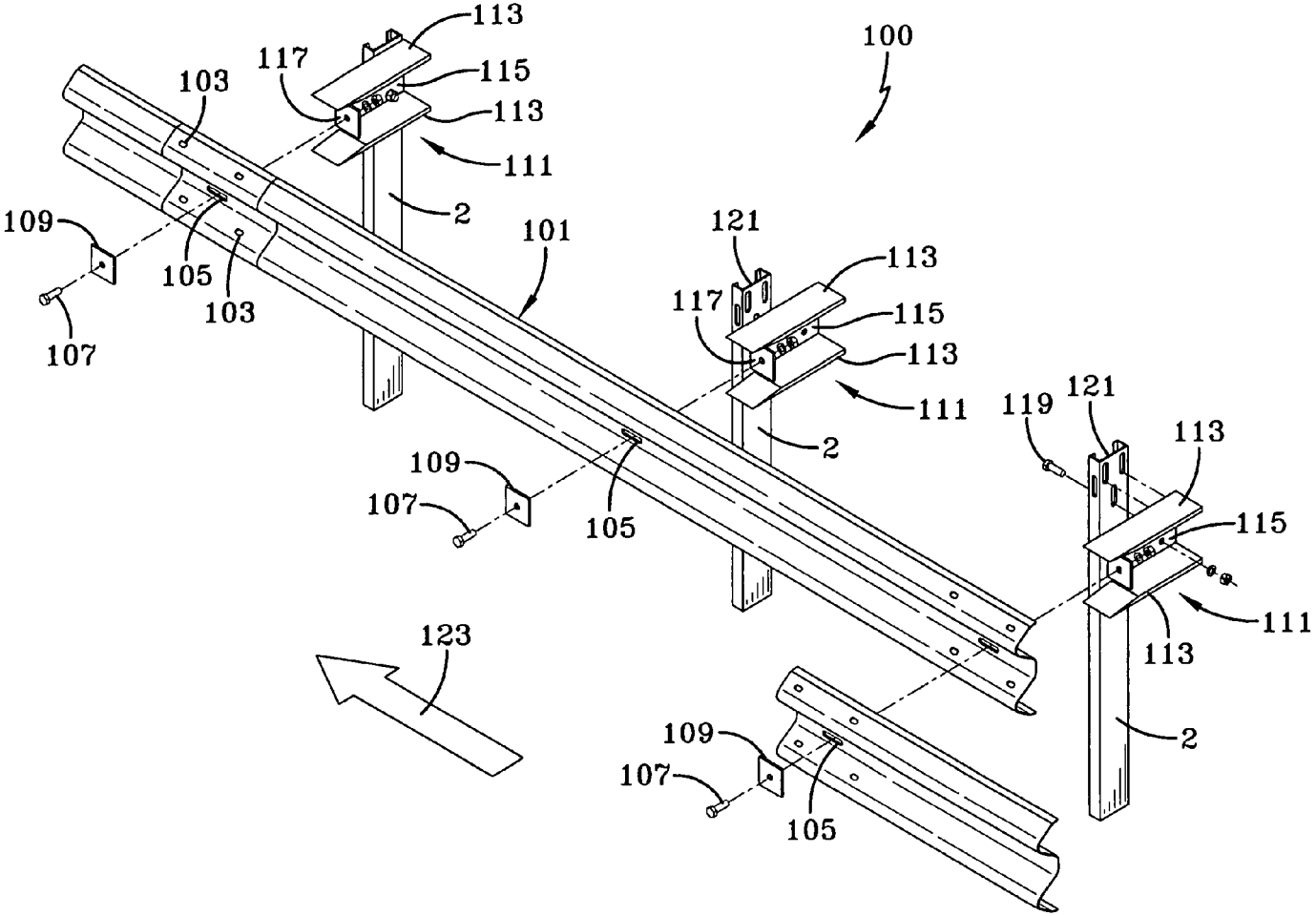
FIG. 12 is an exploded view of a guardrail assembly with which the present invention could be used.

A preferred manufacturing operation and machine line for making visual highlight accessory will now be described with reference to FIG. 11 showing a machine line 30 schematically. A coil 32 of galvanized steel sheet 34 having been painted with yellow traffic paint as described earlier is positioned on an uncoiler 36. Galvanized steel sheet 34 proceeds through a coater 38, which coats sheet 34 with a mixture of clear varnish with mica particles as also discussed above. Coated sheet 34 proceeds through a UV oven 40 for curing the varnish with mica particles thereon. Cured sheet 34 then progresses to a press 42, which punches the required holes in the flat sheet 44. In the example discussed above, there would be four holes 17 and 23 (two of each) punched in sheet 34. Sheet 34 then proceeds to a roll former 44 which rolls sheet 34 so that it has the configuration of the guardrail to which the visual highlight accessory is to be attached. If the guardrail is the W-beam guardrail 1 discussed above with two crowns 7 and 9 thereon, sheet 34 would be rolled in roll former 44 to have the same shape as crowns 7 and 9. Shaped sheet 34 then proceeds through a cutting press 46 which cuts shaped sheet 34 into pieces having the desired length, which could be the same length as the horizontal components of guardrail 1. Finally, the foregoing pieces are stacked in a panel stacker 48, which does not require workers to manually stack the pieces. The pieces could be strapped together for shipment.

The invention has been described in detail with particular reference to the preferred embodiments, but variations and modifications may occur to those skilled in the art from the preceding description and from the appended claims.

I claim:

1. An apparatus for enhancing the visibility of guardrails, the guardrails each having a highway-facing side and a non-highway-facing side, the guardrails being attached to vertically-anchored posts and extending horizontally between the vertically-anchored posts, the respective guardrails each having a double-wave shape comprising an upper crown and a lower crown on the highway-facing side of the respective installed guardrails, the upper crown and the lower crown connected by an integral component, the upper crown and the lower crown having a convex shape and the integral component having a concave shape forming the double-wave shape, the guardrails having guardrail orifices disposed in the upper crown and lower crown at two locations along the length of the respective guardrails for attaching respective guardrails sequentially together in an overlapping manner with fasteners going through the respective guardrail orifices when the guardrail orifices of two respective guardrails are aligned with one another, said apparatus comprising:

a first guardrail visual highlight accessory made from a rigid material selected from the group consisting of metal and polyvinyl chloride, the first guardrail visual highlight accessory having a convex shape corresponding to substantially the entire convex shape of the upper crown of a selected one of the respective guardrails on which the guardrail visual highlight accessory is attached and a length corresponding to at least a portion of the length of the selected guardrail to render said first guardrail visual highlight accessory attached to the respective highway-facing side of the selected guardrail, said first guardrail visual highlight accessory being attached to the upper crown of the selected guardrail via accessory orifices located in the first guardrail visual highlight accessory, wherein the accessory orifices are aligned with the respective guardrail orifices of the respective guardrails to enable said accessory orifices to receive the same fasteners extending through the aligned guardrail orifices to attach said guardrail visual highlight accessory to the respective overlapping guardrails;

wherein a second guardrail visual highlight accessory identical to the first guardrail visual highlight accessory is attachable to the lower crown of the respective guardrail via the guardrail orifices located in the lower crown of the respective guardrails;

wherein the guardrail visual highlight accessories further comprise a visible coating for enhancing the visibility of said guardrail visual highlight accessories during daylight hours and at night time for vehicle drivers driving along a highway having the guardrails extending along the border of the highway.

2. The apparatus according to claim 1 and further comprising an overcoating having visible particles in said overcoating.

3. The apparatus according to claim 2 wherein said overcoating comprises a clear varnish with mica particles.

4. The apparatus according to claim 1 and further including fins attached to and extending from the respective guardrail visual highlight accessories in the direction of the highway-facing side of the guardrails, said fins having a reflective covering for rendering said fins visible to persons in vehicles driving along the highway bordered by said guardrail visual highlight accessory.

5. The apparatus according to claim 4 wherein said reflective covering is a reflective tape.

6. The apparatus according to claim 4 wherein said fins comprise base portions adjacent said guardrail visual highlight accessory, and a blade at said respective base portions, and said guardrail visual highlight accessory has slits for receiving said respective blades for mounting said respective fins on said respective visual highlight accessories.

7. The apparatus according to claim 6 wherein said respective blades are dimensioned larger than said respective slits and are held in said respective slits devoid of fasteners, impeding theft of said fins.

8. The apparatus according to claim 4 wherein said respective fins respectively have free ends distal said guardrail visual highlight accessory when said respective fins are mounted on said guardrail visual highlight accessory, and said respective fins have folds at said respective free ends.

9. The apparatus according to claim 1 wherein said metal is selected from the group consisting of galvanized steel and aluminum.

10. The apparatus according to claim 1 wherein said visible coating on said guardrail visual highlight accessory comprises both a paint coating comprising yellow traffic RAL 1023 yellow paint, and an overcoating comprising mica particles mixed with a varnish selected from the group consisting of a fluoropolymer coil coating and having the following composition:

| Name | CAS number | % |
|---|---|---|
| 2-methoxy-1-methylethyl acetate | 108-65-6 | 10-30 |
| Toluene | 108-88-3 | 10-30 |
| Ethyl acetate | 141-78-6 | 7-13 |
| Copper chromite black spinel | 68186-91-4 | 5-10 |
| Ethanol | 64-17-5 | 1-5 |
| Titanium dioxide | 13463-67-7 | 0.5-1.5 |
| 2-methoxypropyl acetate | 70657-70-4 | 0.1-1 |

coil coating.

* * * * *